US008824709B2

(12) United States Patent
Li

(10) Patent No.: US 8,824,709 B2
(45) Date of Patent: Sep. 2, 2014

(54) GENERATION OF 3D SOUND WITH ADJUSTABLE SOURCE POSITIONING

(75) Inventor: Yunhong Li, Santa Clara, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 395 days.

(21) Appl. No.: 12/925,121

(22) Filed: Oct. 14, 2010

(65) Prior Publication Data

US 2012/0093348 A1 Apr. 19, 2012

(51) Int. Cl.
*H04R 5/02* (2006.01)
*H04S 3/00* (2006.01)

(52) U.S. Cl.
CPC ..... *H04S 3/002* (2013.01)
USPC ..... 381/300; 381/80; 381/81; 381/310; 381/61

(58) Field of Classification Search
CPC ..... G10L 19/008; H04R 2440/01; H04R 2430/23; H04R 2430/25; H04R 2499/11; H04R 2499/13; H04R 2420/01; H04R 2205/024; H04R 2203/00; H04R 2203/12; H04R 2201/40; H04R 2201/401; H04R 2201/403; H04R 2201/405; H04R 3/12; H04R 3/14; H04R 29/002; H04S 1/002; H04S 1/007; H04S 3/002; H04S 5/00; H04S 5/005; H04S 5/02; H04S 7/308; H04S 2400/01; H04S 2400/11
USPC ..... 381/1, 2, 10, 17, 18, 19, 20, 21, 22, 23, 381/77, 80, 81, 303, 304, 305, 307, 309, 381/310, 61, 332, 103, 119, 62, 63
See application file for complete search history.

(56) References Cited

U.S. PATENT DOCUMENTS

| | | | | |
|---|---|---|---|---|
| 7,085,542 | B2 | 8/2006 | Dietrich et al. | |
| 7,515,719 | B2 | 4/2009 | Hooley et al. | |
| 7,577,260 | B1 * | 8/2009 | Hooley et al. | 381/77 |
| 2003/0031333 | A1 * | 2/2003 | Cohen et al. | 381/303 |
| 2003/0109314 | A1 | 6/2003 | Ku | |
| 2005/0025326 | A1 | 2/2005 | Hussaini et al. | |
| 2006/0050897 | A1 * | 3/2006 | Asada et al. | 381/98 |
| 2006/0177078 | A1 * | 8/2006 | Chanda et al. | 381/309 |
| 2007/0253575 | A1 | 11/2007 | Melanson | |
| 2007/0253583 | A1 | 11/2007 | Melanson | |

(Continued)

FOREIGN PATENT DOCUMENTS

JP 2000167240 A 6/2000

OTHER PUBLICATIONS

"YSP-11001", Yamaha, Sep. 2, 2010, 3 pages.

(Continued)

*Primary Examiner* — Leshui Zhang
(74) *Attorney, Agent, or Firm* — Andrew Viger; Frederick J. Telecky, Jr.

(57) ABSTRACT

A system for generating 3D sound with adjustable source positioning includes a first stage and a second stage, which is coupled to the first stage and to a speaker array that includes a plurality of speakers. The first stage is configured to position a plurality of virtual sound sources through a positioner output. The second stage is configured to generate a 3D signal for the speaker array based on the positioner output. The speaker array is configured to generate a 3D sound stage including the virtual sound sources based on the 3D signal. The first stage may be further configured to reposition the virtual sound sources.

15 Claims, 9 Drawing Sheets

(56) References Cited

U.S. PATENT DOCUMENTS

| | | | |
|---|---|---|---|
| 2008/0037813 | A1 | 2/2008 | Entner |
| 2008/0101631 | A1 | 5/2008 | Jung et al. |
| 2009/0161880 | A1 | 6/2009 | Hooley et al. |
| 2009/0296954 | A1 | 12/2009 | Hooley et al. |

OTHER PUBLICATIONS

"Multi-channel surround sound from a single component . . . ", www.yamaha.com/yec/ysp1/resources/ysp_bro_06.pdf, 2005, 7 pages.

"Multi-channel surround sound enjoyment from a single component . . . ", www.yamaha.com/yec/ysp1/resources/ysp1_brochure.pdf, (No date), 4 pages.

"Binaural Technology for Mobile Applications", by staff technical writer, J. Audio Eng. Soc., vol. 54, No. 10, Oct. 2006, p. 990-995.

Wei Ma, et al., "Beam Forming in Spatialized Audio Sound Systems Using Distributed Array Filters", U.S. Appl. No. 12/874,502, filed Sep. 2, 2010.

Yunhong Li, et al., "Case for Providing Improved Audio Performance in Portable Game Consoles and Other Devices", U.S. Appl. No. 12/879,749, filed Sep. 10, 2010.

Notification of Transmittal of the International Search Report and The Written Opinion of the International Searching Authority, or the Declaration dated May 30, 2011 in connection with International Patent Application No. PCT/US2010/048456.

Notification of Transmittal of the International Search Report and The Written Opinion of the International Searching Authority, or the Declaration dated Jun. 3, 2011 in connection with International Patent Application No. PCT/US2010/047658.

* cited by examiner

GENERATION OF 3D SOUND WITH ADJUSTABLE SOURCE POSITIONING

CROSS-REFERENCE TO RELATED APPLICATION

This application is related to U.S. patent application Ser. No. 12/874,502 filed on Sep. 2, 2010, which is hereby incorporated by reference.

TECHNICAL FIELD

This disclosure is generally directed to audio systems. More specifically, this disclosure is directed to generation of 3D sound with adjustable source positioning.

BACKGROUND

Stereo speaker systems have been used in numerous audio applications. A stereo speaker system usually generates a sound stage that is restricted by the physical locations of the speakers. Thus, a listener would perceive sound events limited to within the span of the two speakers. Such a limitation greatly impairs the perceived sound stage in small-size stereo speaker systems, such as those found in portable devices. In the worst cases, the stereo sound almost diminishes into mono sound.

To overcome the size limitation of small stereo systems and widen the sound stage for general stereo systems, 3D sound generation techniques may be implemented. These techniques usually expand the stereo sound stage by achieving better crosstalk cancellation, as well as enhancing certain spatial cues. However, the 3D effects generated by a stereo speaker system using conventional 3D sound generation techniques are generally not satisfactory because the degrees of freedom in the design are limited by the number of speakers.

BRIEF DESCRIPTION OF DRAWINGS

For a more complete understanding of this disclosure and its features, reference is now made to the following description, taken in conjunction with the accompanying drawings, in which.

DETAILED DESCRIPTION

FIGS. 1 through 8, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1A:
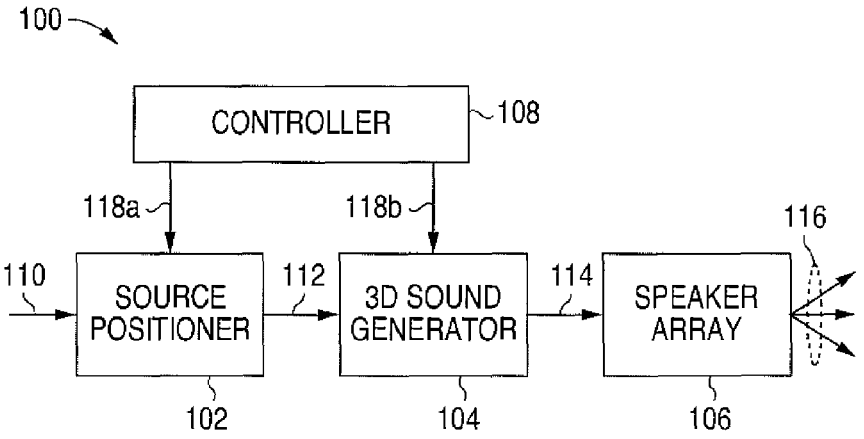
FIG. 1A illustrates an audio system capable of generating 3D sound with adjustable source positioning in accordance with one embodiment of this disclosure.

FIG. 1A illustrates an audio system 100 capable of generating 3D sound with adjustable source positioning in accordance with one embodiment of this disclosure. The audio system 100 comprises a source positioner 102, a 3D sound generator 104 and a speaker array 106. For some embodiments, the audio system 100 may also comprise a controller 108.

The source positioner 102 is capable of receiving an audio input 110 and generating a positioner output 112 based on the audio input 110, as described in more detail below. The 3D sound generator 104 is coupled to the source positioner 102 and is capable of receiving the positioner output 112 and generating a 3D signal 114 based on the positioner output 112, as described in more detail below. The speaker array 106, which is coupled to the 3D sound generator 104, comprises a plurality of speakers and is capable of receiving the 3D signal 114 and generating a customizable 3D sound stage 116 based on the 3D signal 114, as described in more detail below. Each speaker in the speaker array 106 may comprise any suitable structure for generating sound, such as a moving coil speaker, ceramic speaker, piezoelectric speaker, subwoofer, or any other type of speaker.

For the embodiments that include the controller 108, the controller 108 may be coupled to the source positioner 102 and/or the 3D sound generator 104 and is capable of generating control signals 118 for the audio system 100. For example, the controller 108 may be capable of generating a position control signal 118*a* for the source positioner 102, and the source positioner 102 may then be capable of generating the positioner output 112 based on both the audio input 110 and the position control signal 118*a*. Similarly, the controller 108 may be capable of generating a 3D control signal 118*b* for the 3D sound generator 104, and the 3D sound generator 104 may then be capable of generating the 3D signal 114 based on both the positioner output 112 and the 3D control signal 118*b*.

For some embodiments, the controller 108 may be capable of bypassing the source positioner 102 and/or the 3D sound generator 104. Thus, for example, the controller 108 may use the position control signal 118*a* to bypass the source positioner 102, thereby providing the audio input 110 directly to the 3D sound generator 104. The controller 108 may also use the 3D control signal 118*b* to bypass the 3D sound generator 104, thereby providing the positioner output 112 directly to the speaker array 106.

In general, the 3D sound generator 104 is capable of generating the 3D signal 114 such that a 3D sound stage 116 may be produced for a listener, allowing the listener to hear through virtual speakers a sound stage 116 that sounds as if it is being generated by sound sources at locations other than the speakers 106 themselves, i.e., at the locations of the virtual speakers.

The source positioner 102 is capable of adjusting the relative positions of those sound sources, making them sound as if they are closer together or farther apart based on the customization desired. For one example, the controller 108 may direct the source positioner 102 to adjust the positions of the sound sources through the position control signal 118*a*. For some embodiments, the controller 108 and/or the source positioner 102 may be controlled by a manufacturer or user of the audio system 100 in order to achieve the desired source positioning.

In this way, a two-stage system 100 is implemented that provides for the creation of virtual speakers through one stage, i.e., the 3D sound generator 104, and provides for an adjustable separation between the virtual speakers through another stage, i.e., the source positioner 102.

Figure 1B:
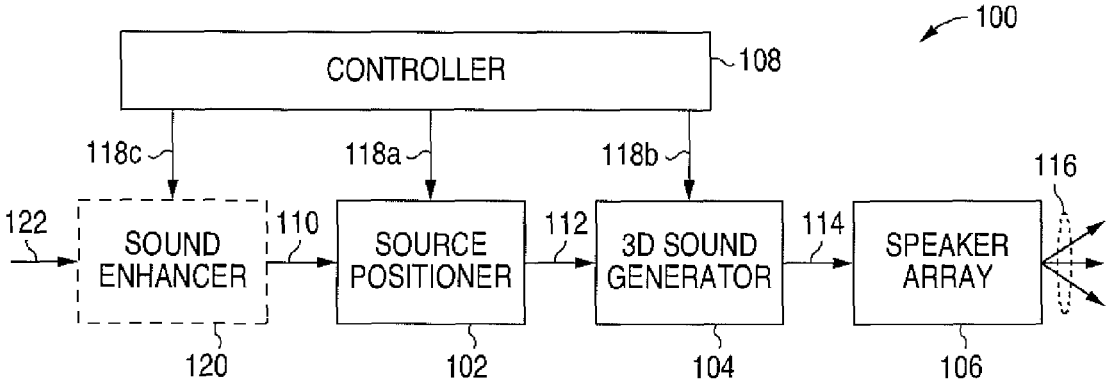
FIG. 1B illustrates the audio system of FIG. 1A in accordance with another embodiment of this disclosure.

FIG. 1B illustrates the audio system 100 in accordance with another embodiment of this disclosure. For this embodiment, the audio system 100 comprises an optional third stage, which is an optional sound enhancer 120 that is coupled to the source positioner 102. For this embodiment, the sound enhancer 120 is capable of receiving an unenhanced input 122 and generating the audio input 110 for the source positioner 102 based on the unenhanced input 122. For some embodiments, the controller 108 may be coupled to the sound enhancer 120 and may be capable of generating an enhancement control signal 118*c* for the sound enhancer 120. For these embodiments, the sound enhancer 120 is capable of generating the audio input 110 based on both the unenhanced input 122 and the enhancement control signal 118*c*. The sound enhancer 120 may generate the audio input 110 by enhancing the unenhanced input 122 in any suitable manner. The sound enhancer 120 may enhance the unenhanced input 122 by inserting positive effects into the unenhanced input 122 and/or by reducing or eliminating negative aspects of the unenhanced input 122. For example, for a particular embodiment, the sound enhancer 120 may be capable of providing for the Hall effect and/or reverberance.

Figure 2A:
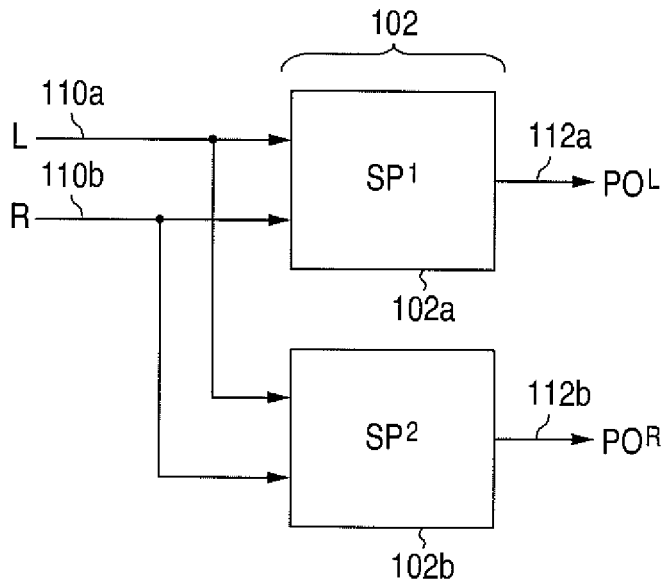
FIG. 2A illustrates the source positioner of FIG. 1A or 1B for the case of mono or stereo inputs in accordance with one embodiment of this disclosure.

FIG. 2A illustrates the source positioner 102 for the case of mono or stereo inputs 110 in accordance with one embodiment of this disclosure. For this embodiment, the source positioner 102 comprises a first source positioner ($SP_1$) 102*a* and a second source positioner ($SP_2$) 102*b*. The audio input 110 for this embodiment comprises a left input 110*a* and a right input 110*b*, each of which is coupled to each of the source positioners 102*a* and 102*b*. The positioner output 112 for this embodiment comprises a left positioner output ($PO_L$) 112*a* and a right positioner output ($PO_R$) 112*b*. The $SP_1$ 102*a* is capable of generating the left positioner output 112*a* based on the left input 110*a* and the right input 110*b*. Similarly, the $SP_2$ 102*b* is capable of generating the right positioner output 112*b* based on the left input 110*a* and the right input 110*b*. For the case of a mono input 110, either of the audio inputs 110*a* or 110*b* may be muted or, alternatively, the mono input 110 may be fed to both the left input 110*a* and the right input 110*b*.

Figure 2B:
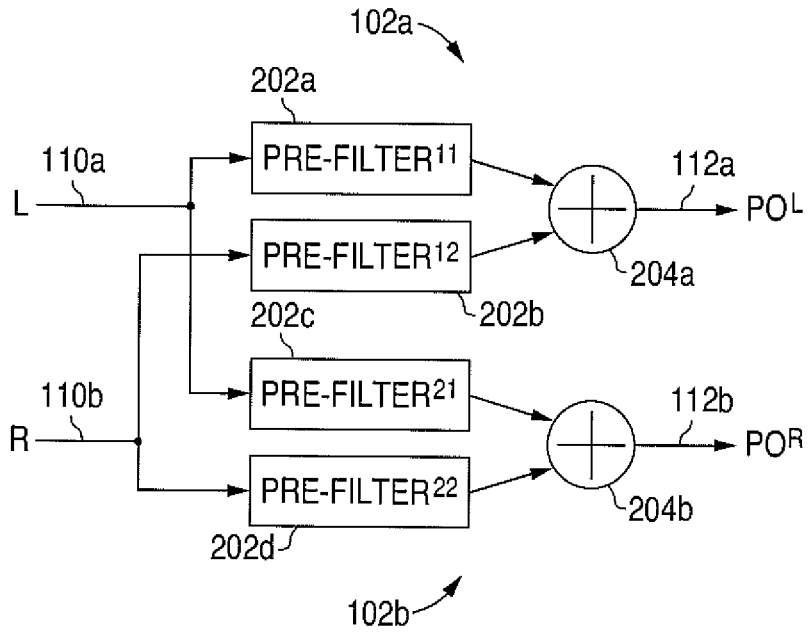
FIG. 2B illustrates details of the source positioner of FIG. 2A in accordance with one embodiment of this disclosure.

FIG. 2B illustrates details of the source positioner 102 of FIG. 2A in accordance with one embodiment of this disclosure. For this embodiment, the $SP_1$ 102*a* comprises a first pre-filter (pre-filter$_{11}$) 202*a*, a second pre-filter (pre-filter$_{12}$) 202*b* and a mixer 204*a*, and the $SP_2$ 102*b* comprises a first pre-filter (pre-filter$_{21}$) 202*c*, a second pre-filter (pre-filter$_{22}$) 202*d* and a mixer 204*b*.

For some embodiments, each pre-filter 202 may comprise a digital filter. The pre-filters 202 are each capable of adding spatial cues into the audio input 110 in order to control the span of the sound stage 116. For a particular embodiment, the pre-filters 202 may each be capable of applying a public or custom Head-Related Transfer Function (HRTF). HRTFs have been used in headphones to achieve sound source externalization and to create surround sound. In addition, HRTFs contain unique spatial cues that allow a listener to identify a sound source from a particular angle at a particular distance. Through HRTF filtering, spatial cues may be introduced to customize the 3D sound stage 116. For pre-filters 202 capable of applying HRTFs, the horizontal span of the sound stage 116 may be easily controlled by loading HRTFs in the pre-filters 202 that correspond to the desired angles. For some embodiments, the controller 108 may load an appropriate HRTF into each pre-filter 202 through the position control signal 118*a*.

The pre-filter$_{11}$ 202*a* is capable of receiving the left input 110*a* and filtering the left input 110*a* by applying an HRTF or other suitable function. Similarly, the pre-filter$_{12}$ 202*b* is capable of receiving the right input 110*b* and filtering the right input 110*b* by applying an HRTF or other suitable function. The mixer 204*a* is capable of mixing the filtered left and right inputs to generate the left positioner output 112*a*.

The pre-filter$_{21}$ 202*c* is capable of receiving the left input 110*a* and filtering the left input 110*a* by applying an HRTF or other suitable function. Similarly, the pre-filter$_{22}$ 202*d* is capable of receiving the right input 110*b* and filtering the right input 110*b* by applying an HRTF or other suitable function. The mixer 204*b* is capable of mixing the filtered left and right inputs to generate the right positioner output 112*b*.

Thus, if at least one of the pre-filters 202 is loaded with a different function for filtering the audio input 110, the source positioner 102 will generate a different positioner output 112, which may correspond to a different left positioner output 112*a* and/or a different right positioner output 112*b*, in order to reposition the sound stage 116.

Figure 3A:
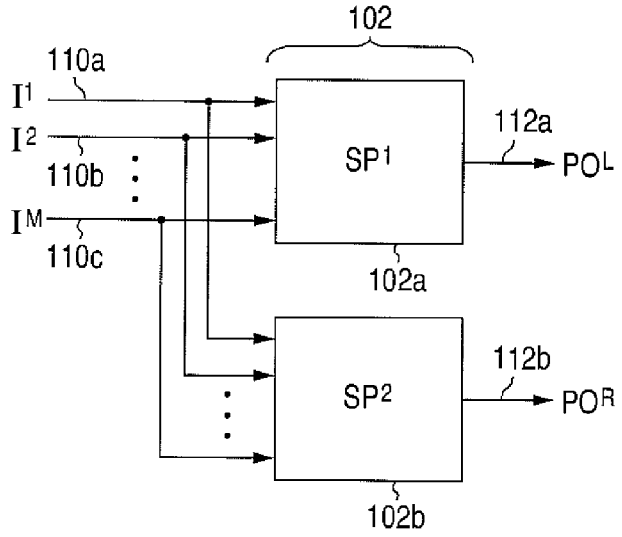
FIG. 3A illustrates the source positioner of FIG. 1A or 1B for the case of multi-channel inputs in accordance with one embodiment of this disclosure.

FIG. 3A illustrates the source positioner 102 for the case of multi-channel inputs 110 in accordance with one embodiment of this disclosure. For this embodiment, the source positioner 102 comprises a first source positioner ($SP_1$) 102*a* and a second source positioner ($SP_2$) 102*b*. The audio input 110 for this embodiment comprises more than two inputs, which are represented as inputs 1 through M (with M>2) in FIG. 3A. Each of the inputs 110*a-c* is coupled to each of the source positioners 102*a* and 102*b*. The positioner output 112 for this embodiment comprises a left positioner output ($PO_L$) 112*a* and a right positioner output ($PO_R$) 112*b*. The $SP_1$ 102*a* is capable of generating the left positioner output 112*a* based on inputs 1 through M 110*a-c*. Similarly, the $SP_2$ 102*b* is capable of generating the right positioner output 112*b* based on inputs 1 through M 110*a-c*.

Figure 3B:
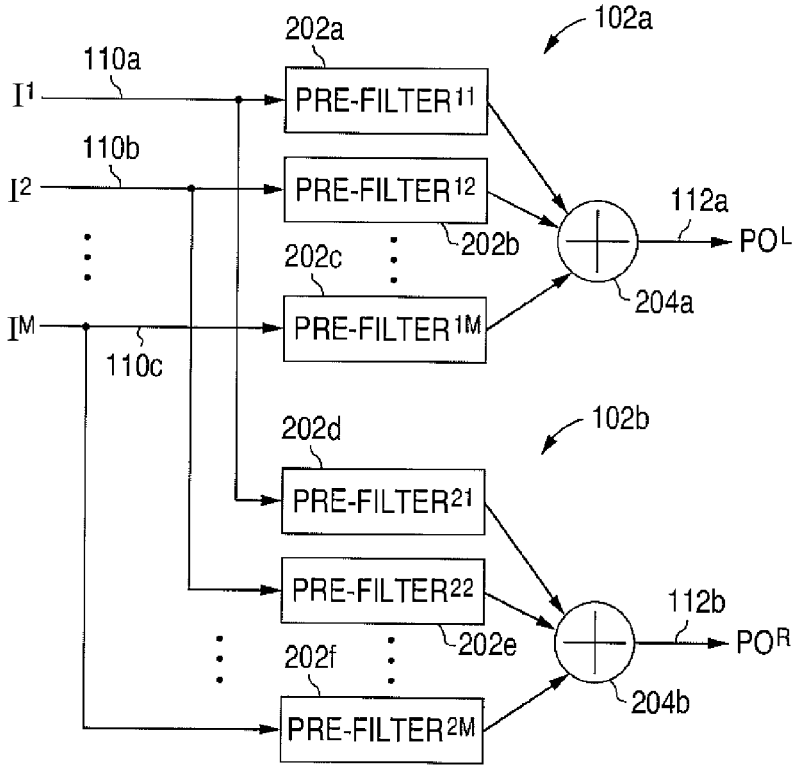
FIG. 3B illustrates details of the source positioner of FIG. 3A in accordance with one embodiment of this disclosure.

FIG. 3B illustrates details of the source positioner 102 of FIG. 3A in accordance with one embodiment of this disclosure. For this embodiment, the $SP_1$ 102*a* comprises a plurality of pre-filters 202, with the number of pre-filters 202 equal to the number of inputs 110. The illustrated embodiment shows M inputs 110 and, thus, the $SP_1$ 102*a* comprises M pre-filters 202. The first, second and last pre-filters 202 are explicitly shown as pre-filter$_{11}$ 202*a*, pre-filter$_{12}$ 202*b* and pre-filter$_{1M}$ 202*c*, respectively. The $SP_1$ 102*a* also comprises a mixer 204*a*. Similarly, the $SP_2$ 102*b* comprises M pre-filters 202. The first, second and last pre-filters 202 are explicitly shown as pre-filter$_{21}$ 202*d*, pre-filter$_{22}$ 202*e* and pre-filter$_{2M}$ 202*f*, respectively. The SP$_2$ also comprises a mixer 204*b*.

It will be understood that the source positioners 102*a* and 102*b* may each comprise more pre-filters 202 than the number of inputs 110. However, if there are more pre-filters 202 than inputs 110, the additional pre-filters 202 will be unused. Thus, the number of pre-filters 202 provides a maximum number of inputs 110.

For some embodiments, each pre-filter 202 may comprise a digital filter. The pre-filters 202 are each capable of adding spatial cues into the audio input 110 in order to control the span of the sound stage 116. For a particular embodiment, the pre-filters 202 may each be capable of applying a conventional Head-Related Transfer Function (HRTF). HRTFs have been used in headphones to achieve sound source externalization and to create surround sound. In addition, HRTFs contain unique spatial cues that allow a listener to identify a sound source from a particular angle at a particular distance. Through HRTF filtering, spatial cues may be introduced to customize the 3D sound stage 116. For pre-filters 202 capable of applying HRTFs, the horizontal span of the sound stage 116 may be easily controlled by loading HRTFs in the pre-filters 202 that correspond to the desired angles. For some embodiments, the controller 108 may load an appropriate HRTF into each pre-filter 202 through the position control signal 118*a*.

The pre-filter$_{11}$ 202*a* and the pre-filter$_{21}$ 202*d* are each capable of receiving the first input ($I_1$) 110*a* and filtering the first input 110*a* by applying an HRTF or other suitable function loaded into that particular pre-filter 202*a* or 202*d*. Similarly, the pre-filter$_{12}$ 202*b* and the pre-filter$_{22}$ 202*e* are each capable of receiving the second input ($I_2$) 110*b* and filtering the second input 110*b* by applying an HRTF or other suitable function loaded into that particular pre-filter 202*b* or 202*e*. Each pre-filter 202 is capable of operating in the same way down through the last pre-filters 202*c* and 202*f*, which are each capable of receiving the final input ($I_M$) 110*c* and filtering the final input 110*c* by applying an HRTF or other suitable function loaded into that particular pre-filter 202*c* or 202*f*.

The mixer 204*a* is capable of mixing the filtered inputs generated by the SP$_1$ pre-filters 202*a-c* to generate the left positioner output 112*a*. Similarly, the mixer 204*b* is capable of mixing the filtered inputs generated by the SP$_2$ pre-filters 202*d-f* to generate the right positioner output 112*b*.

Thus, if at least one of the pre-filters 202 is loaded with a different function for filtering the audio input 110, the source positioner 102 will generate a different positioner output 112, which may correspond to a different left positioner output 112*a* and/or a different right positioner output 112*b*, in order to reposition the sound stage 116.

Figure 4A:
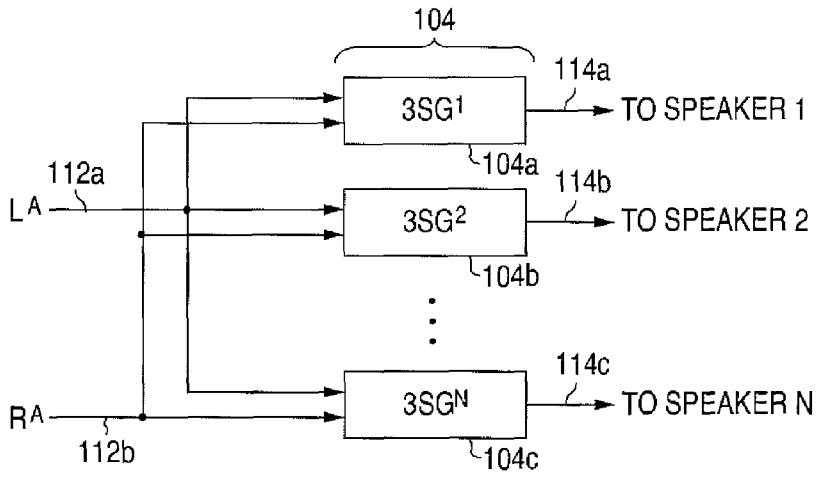
FIG. 4A illustrates the 3D sound generator of FIG. 1A or 1B in accordance with one embodiment of this disclosure.

FIG. 4A illustrates the 3D sound generator 104 in accordance with one embodiment of this disclosure. For this embodiment, the 3D sound generator 104 comprises a plurality of 3D sound generators (3SG$_i$) 104*a-c*, with one 3SG$_i$ for each speaker in the speaker array 106. The 3D signal 114 for this embodiment comprises a plurality of 3D signals 114*a-c*, one for each speaker in the speaker array 106. Each 3SG$_i$ 104 is capable of receiving the left positioner output 112*a* and the right positioner output 112*b* from the source positioner 102 and generating a 3D signal 114 for a corresponding speaker based on the positioner outputs 112*a* and 112*b*.

Figure 4B:
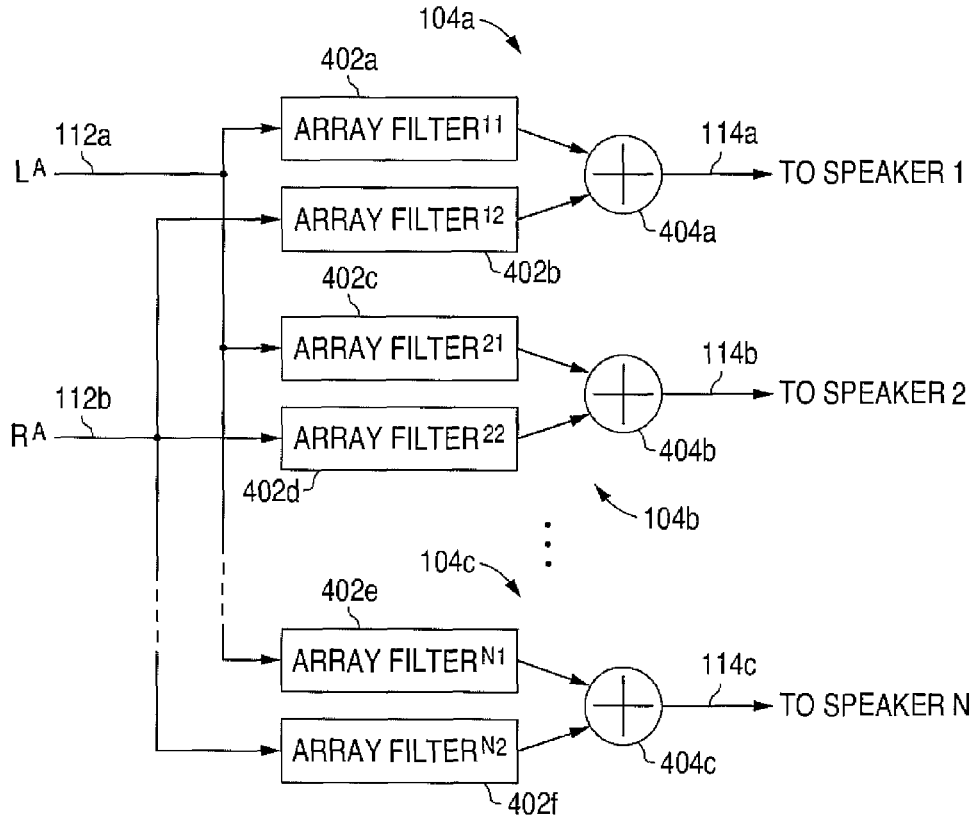
FIG. 4B illustrates details of the 3D sound generator of FIG. 4A in accordance with one embodiment of this disclosure.

FIG. 4B illustrates details of the 3D sound generator 104 of FIG. 4A in accordance with one embodiment of this disclosure. For this embodiment, the 3SG$_1$ 104*a* comprises a first array filter (array filter$_{11}$) 402*a*, a second array filter (array filter$_{12}$) 402*b* and a mixer 404*a*. Similarly, each remaining 3SG$_i$ comprises a first array filter (array filter$_{11}$), a second array filter (array filter$_{12}$) and a mixer.

For some embodiments, each array filter 402 may comprise a digital filter capable of using filter coefficients to provide desired beamforming patterns in the sound stage 116 by filtering audio data. Each array filter 402 may be capable of implementing modified signal delays and amplitudes to support a desired beam pattern for conventional speakers or implementing modified cut-off frequencies and volumes for subwoofer applications. In general, each array filter 402 is capable of changing an audio signal's phase, amplitude and/or other characteristics to generate complex beam patterns in the sound stage 116. For some embodiments, each array filter 402 may comprise calibration and offset compensation circuits for speaker mismatch in phase and amplitude and circuit mismatch in phase and amplitude.

The array filter$_{11}$ 402*a* is capable of receiving the left positioner output 112*a* and filtering the left positioner output 112*a* by applying filter coefficients to the output 112*a*. Similarly, the array filter$_{12}$ 402*b* is capable of receiving the right positioner output 112*b* and filtering the right positioner output 112*b* by applying filter coefficients to the output 112*b*. The mixer 404*a* is capable of mixing the filtered, left and right positioner outputs to generate a 3D signal 114*a* for Speaker1.

Similarly, each first array filter$_{11}$ is capable of receiving the left positioner output 112*a* and filtering the left positioner output 112*a*, and each second array filter$_{12}$ is capable of receiving the right positioner output 112*b* and filtering the right positioner output 112*b*. The mixer 404 corresponding to each pair of array filters 402 is capable of mixing the filtered, left and right positioner outputs 112 to generate a 3D signal 114 for the corresponding speaker.

In this way, each speaker in the speaker array 106 may output a filtered copy of all input channels (whether mono, stereo or multi-channel), and the acoustic outputs from the speaker array 106 are mixed spatially to give the listener a perception of the sound stage 116. Thus, as described above, the 3D signal 114 for each speaker is generated based on the positioner outputs 112*a* and 112*b*, which are in turn generated based on both the left and right inputs 110 for stereo signals or on all the inputs 110 for a multi-channel signal.

The array filters 402 may be designed to generate a directional sound beam that goes toward the ears of the listener. For example, the array filters 402 associated with the left channel(s) are designed to direct the left channel audio to the left ear, while maintaining very limited leaks toward the right ear. Similarly, the array filters 402 associated with the right channel(s) are designed to direct the right channel audio to the right ear, while maintaining very limited leaks toward the left ear.

Thus, the set of array filters 402 of the 3D sound generator 104 is capable of delivering the audio to the desired ear and achieving good cross-talk cancellation between the left and right channels. Also, in this way, each speaker in the speaker array 106 may receive a 3D signal 114 from its own pair of local array filters 402.

Figure 5A:
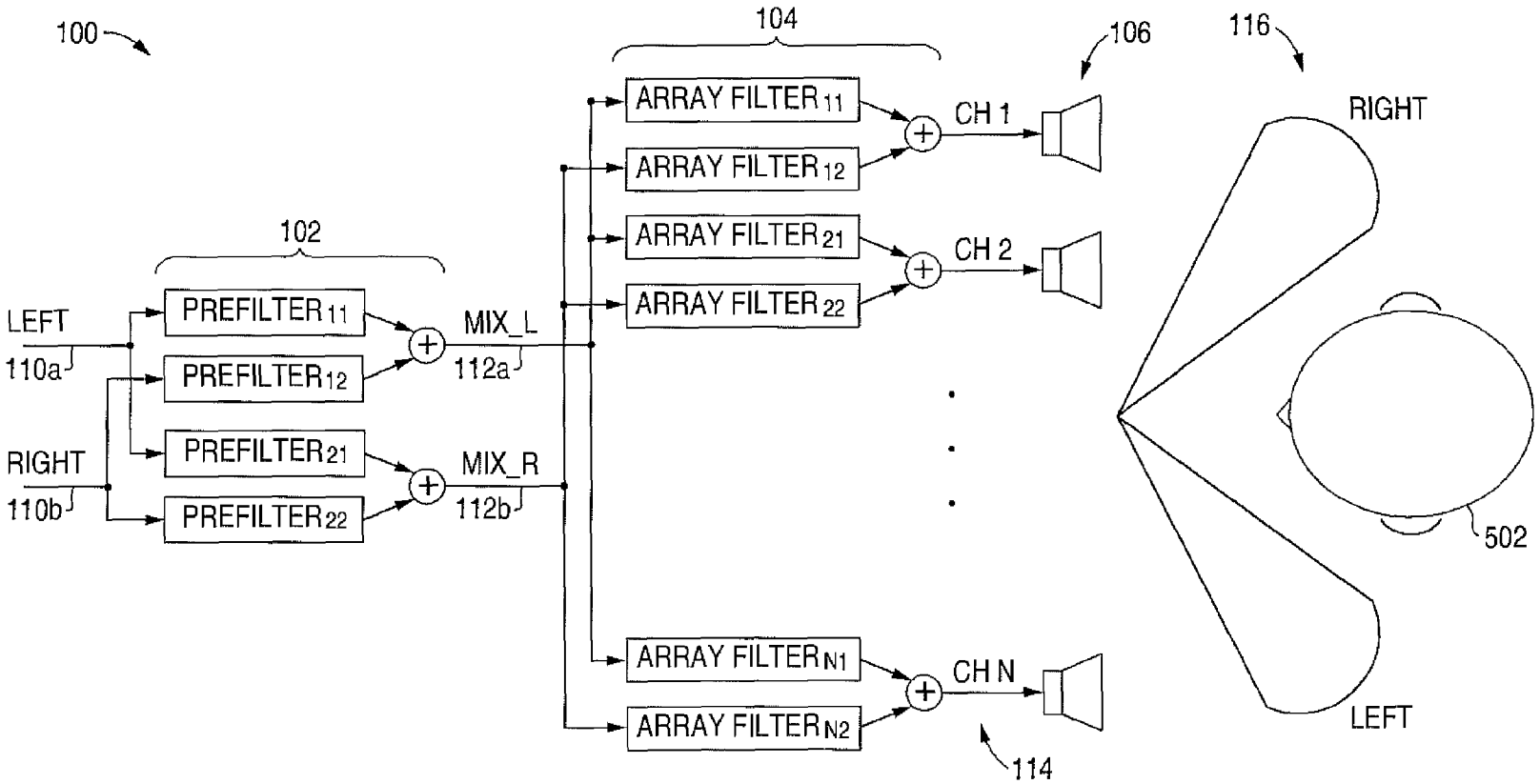
FIG. 5A illustrates the audio system of FIG. 1A or 1B with the source positioner of FIG. 2B and the 3D sound generator of FIG. 4B in accordance with one embodiment of this disclosure.

FIG. 5A illustrates the audio system 100 with the source positioner 102 of FIG. 2B and the 3D sound generator 104 of FIG. 4B in accordance with one embodiment of this disclosure. For this embodiment, a stereo input signal 110 is received at the source positioner 102 and the speaker array 106 generates a 3D sound stage 116 with adjustable source positioning for a listener 502, as described above.

Figure 5B:
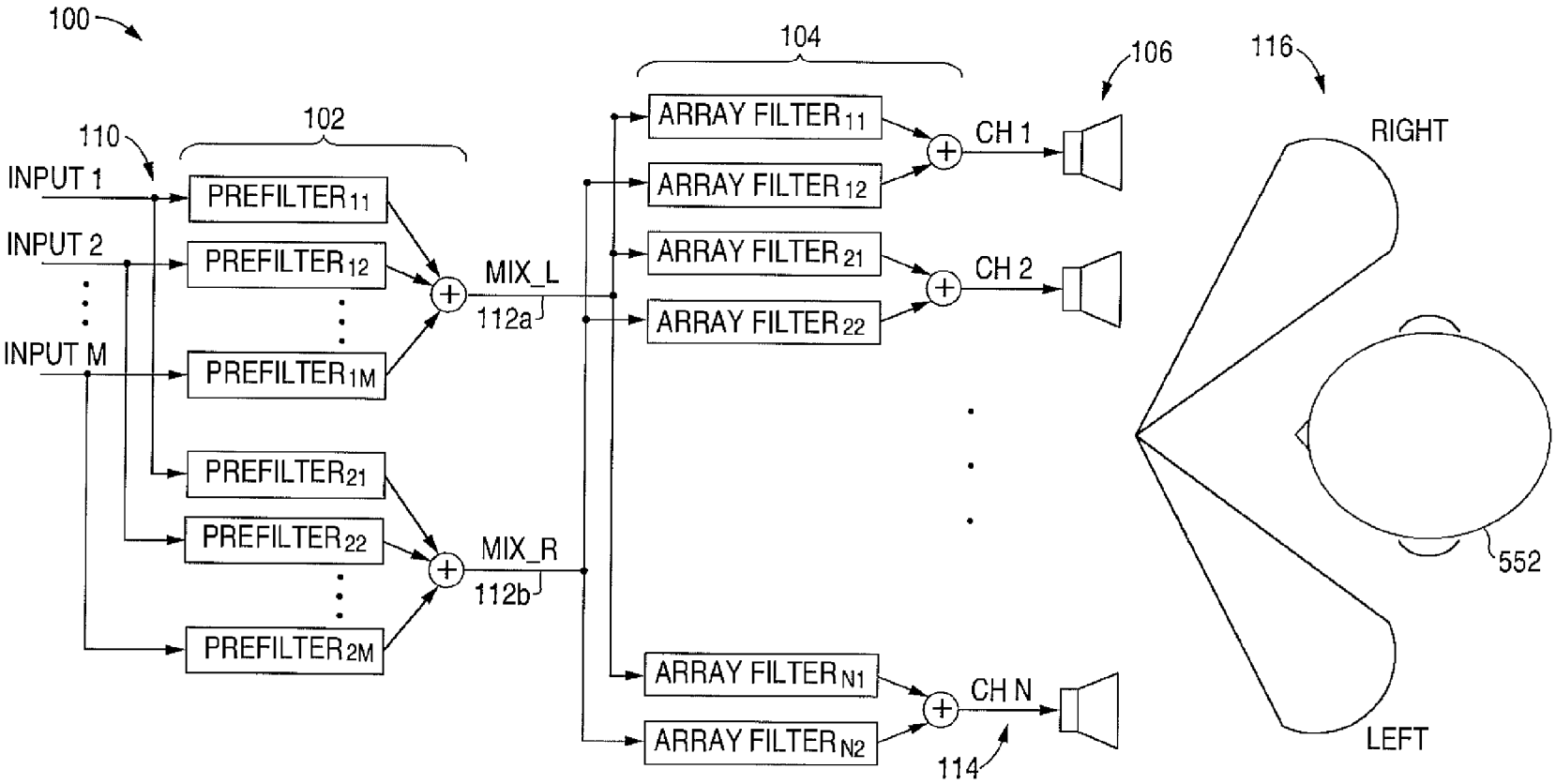
FIG. 5B illustrates the audio system of FIG. 1A or 1B with the source positioner of FIG. 3B and the 3D sound generator of FIG. 4B in accordance with one embodiment of this disclosure.

FIG. 5B illustrates the audio system 100 with the source positioner 102 of FIG. 3B and the 3D sound generator 104 of FIG. 4B in accordance with one embodiment of this disclosure. For this embodiment, an M-input signal 110 is received at the source positioner 102 and the speaker array 106 generates a 3D sound stage 116 with adjustable source positioning for a listener 552, as described above.

Figure 6:
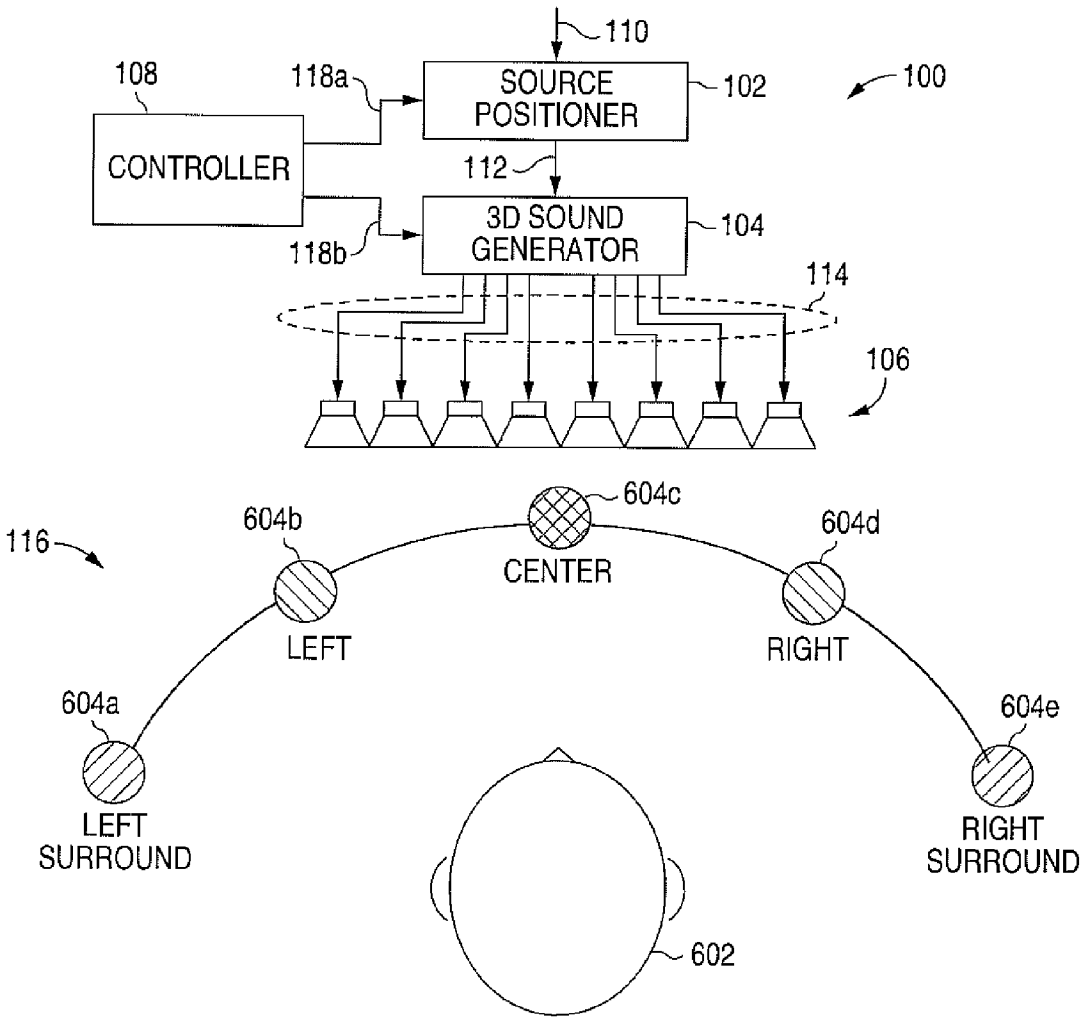
FIG. 6 illustrates one example of a 3D sound stage generated by the audio system of FIG. 1A or 1B in accordance with one embodiment of this disclosure.

FIG. 6 illustrates one example of a 3D sound stage 116 generated by the audio system 100 in accordance with one embodiment of this disclosure. The sound stage 116 comprises a plurality of sound sources 604, each of which represents a virtual source of sound for a listener 602 generated by the audio system 100.

For this particular example, the 3D sound generator 104 generates a 3D signal 114 that results in the speaker array 106 generating a sound stage 116 comprising five sound sources 604*a-e* for the listener 602, as described above. Also, for this example, the speaker array 106 comprises eight speakers. However, it will be understood that the sound stage 116 generated by the audio system 100 may comprise any suitable number of sound sources 604 and the speaker array 106 may comprise any suitable number of speakers without departing from the scope of this disclosure.

The source positioner 102 is capable of modifying the audio input 110 such that the spacing between the resulting sound sources 604*a* and 604*b*, 604*b* and 604*c*, 604*c* and 604*d*, and 604*d* and 604*e* is any suitable distance. For example, for some embodiments, HRTFs are loaded into corresponding pre-filters 202 of the source positioner 102. The source positioner 102 provides a sound stage 116 in which different input channels are positioned at different angles based on those HRTFs.

For some embodiments, the source positioner 102 may be capable of adjusting the spacing uniformly for all sound sources 604. For other embodiments, the source positioner 102 may be capable of adjusting the spacing between any two sound sources 604 independently of the other sound sources 604. The 3D sound generator 104 is capable of generating the 3D signal 114 to correspond to a desired number and curvature of sound sources 604*a-e*.

Figure 7:
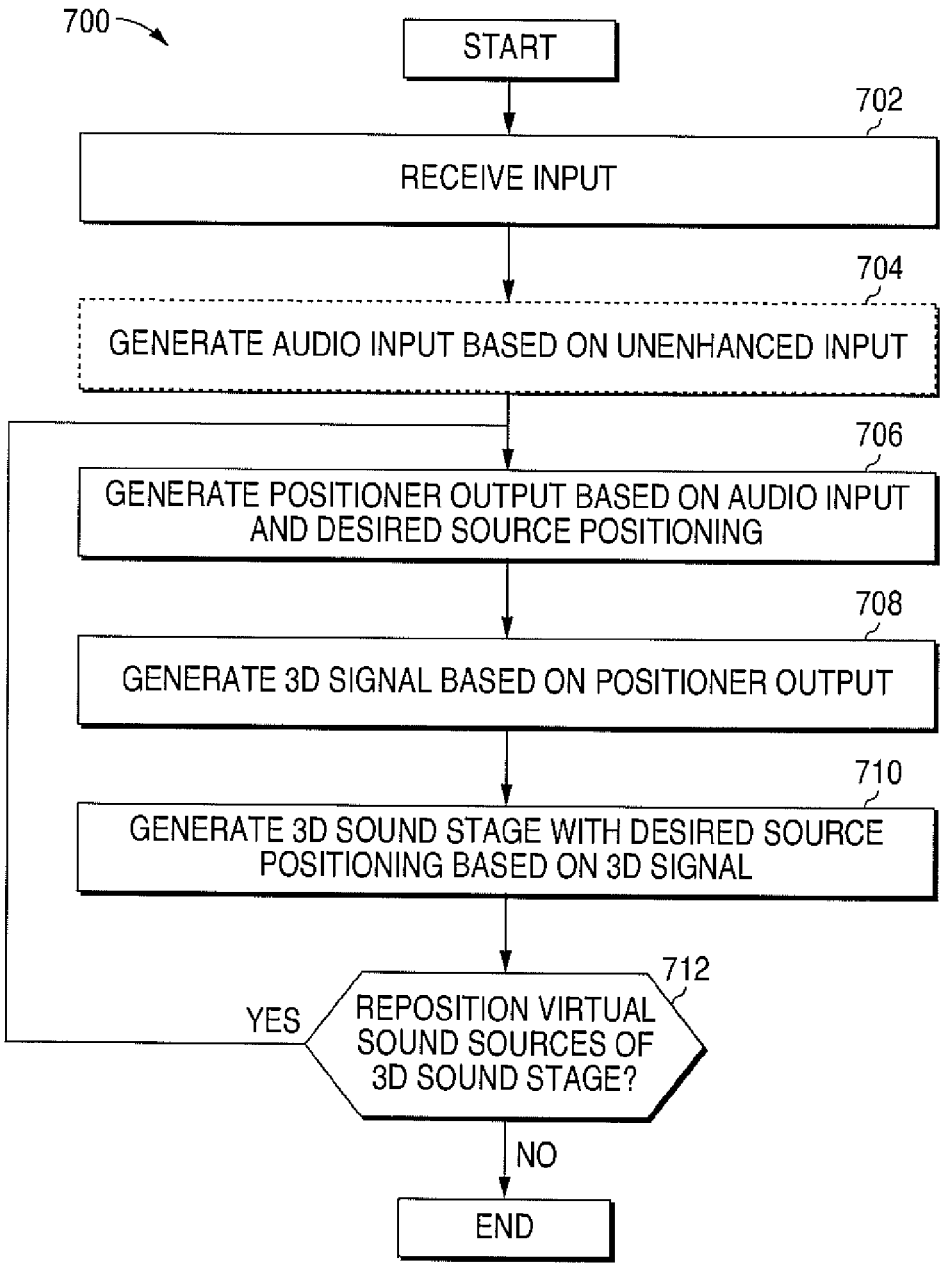
FIG. 7 illustrates a method for generating 3D sound with adjustable source positioning in accordance with one embodiment of this disclosure.

FIG. 7 illustrates a method 700 for generating 3D sound with adjustable source positioning in accordance with one embodiment of this disclosure. Initially, the audio system 100 receives an input (step 702). This input may correspond to the audio input 110, for the embodiment illustrated in FIG. 1A, or to the unenhanced input 122, for the embodiment illustrated in FIG. 1B.

For the embodiment of FIG. 1B, the sound enhancer 120 generates the audio input 110 based on the unenhanced input 122 (optional step 704). For example, the sound enhancer 120 may enhance the unenhanced input 122 by inserting any positive effects and/or reducing or eliminating any negative aspects of the unenhanced input 122. For a particular example, the sound enhancer 120 may generate the audio input 110 by providing for the Hall effect and/or reverberance. Also, the sound enhancer 120 may generate the audio input 110 based on an enhancement control signal 118*c*, in addition to the unenhanced input 122.

The source positioner 102 generates the positioner output 112 based on the audio input 110 and the desired source positioning as determined by a manufacturer or user of the system 100, by the controller 108 or in any other suitable manner (step 706). For example, the source positioner 102 may generate the positioner output 112 by applying one or more functions to the audio input 110, which may comprise a mono input, stereo inputs or multi-channel inputs.

The positioner output 112 may comprise a left positioner output 112*a* and a right positioner output 112*b*. For this embodiment, the source positioner 102 generates each of the positioner outputs 112*a* and 112*b* based on the entire audio input 110, whether that input 110 is a mono signal, a stereo signal or any suitable number of multi-channel signals. For a particular example, the source positioner 102 may generate each positioner output 112*a* and 112*b* by applying an HRTF to each of the audio inputs (mono, stereo or multi-channel) 110 and mixing the filtered inputs. Also, for some embodiments, the source positioner 102 may generate the positioner output 112 based on a position control signal 118*a*, in addition to the audio input 110.

The 3D sound generator 104 generates the 3D signal 114 based on the positioner output 112 (step 708). For example, the 3D sound generator 104 may generate the 3D signal 114 by applying one or more functions to the positioner output 112, which may comprise a left positioner output 112*a* and a right positioner output 112*b*. For some embodiments, the 3D sound generator 104 generates each of a plurality of 3D signals 114 based on both of the positioner outputs 112*a* and 112*b*. For a particular example, the 3D sound generator 104 may generate each 3D signal 114 by applying a function to each of the positioner outputs 112*a* and 112*b* and mixing the filtered outputs. Also, for some embodiments, the 3D sound generator 104 may generate the 3D signal 114 based on a 3D control signal 118*b*, in addition to the positioner output 112.

The speaker array 106 generates the 3D sound stage 116 with the desired source positioning based on the 3D signal 114 (step 710). For some embodiments, each speaker in the speaker array 106 receives a unique 3D signal 114 from the 3D sound generator 104 and generates a portion of the 3D sound stage 116 based on the received 3D signal 114. The sound stage 116 comprises a specified number of sound sources 604 at a specified curvature based on the action of the 3D sound generator 104 and a specified spacing between those sources 604 based on the action of the source positioner 102.

If a user or manufacturer of the system 100 or the controller 108 or other suitable entity desires to reposition the virtual sound sources 604, the method returns to step 706, where the source positioner 102 continues to generate the positioner output 112 based on the audio input 110 but also based on the modified desired source positioning (step 712).

Figure 8:
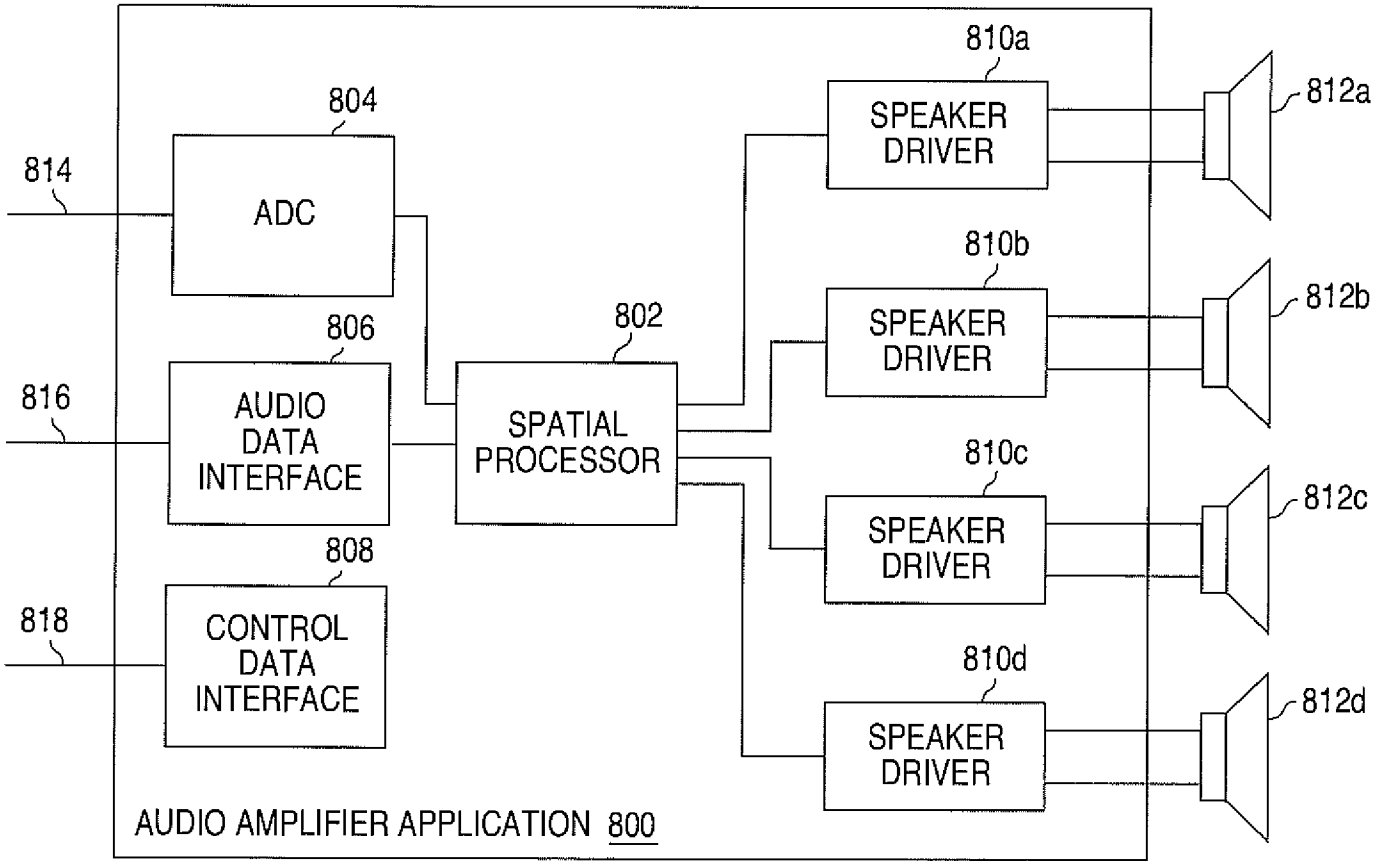
FIG. 8 illustrates one example of an audio amplifier application including the audio system of FIG. 1A or 1B in accordance with one embodiment of this disclosure.

FIG. 8 illustrates one example of an audio amplifier application 800 including the audio system 100 in accordance with one embodiment of this disclosure. For the example illustrated in FIG. 8, the audio amplifier application 800 comprises a spatial processor 802, an analog-to-digital converter (ADC) 804, an audio data interface 806, a control data interface 808 and a plurality of speaker drivers 810*a-d*, each of which is coupled to a corresponding speaker 812*a-d*. It will be understood that the audio amplifier application 800 may comprise any other suitable components not illustrated in FIG. 8.

For this embodiment, the spatial processor 802 comprises the audio system 100 that is capable of generating 3D sound with adjustable source positioning. The analog-to-digital converter 804 is capable of receiving an analog audio signal 814 and converting it into a digital signal for the spatial processor 802. The audio data interface 806 is capable of receiving audio data over a bus 816 and providing that audio data to the spatial processor 802. The control data interface 808 is capable of receiving control data over a bus 818 and may be capable of providing that control data to the spatial processor 802 or other components of the audio amplifier application 800. For some embodiments, the buses 816 and/or 818 may each comprise a SLIMBUS or an $I^2S/I^2C$ bus. However, it will be understood that either bus 816 or 818 may comprise any suitable type of bus without departing from the scope of this disclosure.

The spatial processor 802 is capable of generating 3D sound signals with adjustable source positioning, as described above in connection with FIGS. 1-7. The audio data provided by the analog-to-digital converter 804 and/or the audio data interface 806 may correspond to the audio input 110 of FIG. 1A or the unenhanced input 122 of FIG. 1B. The control data provided by the control data interface 808 may correspond to the control signals 118 or may be provided to an integrated controller, which may generate the control signals 118 based on the control data. Each speaker driver 810 may comprise an H-bridge or other suitable structure for driving the corresponding speaker 812. Although the illustrated embodiment includes four speaker drivers 810*a-d* and four corresponding speakers 812*a-d*, it will be understood that the audio amplifier application 800 may comprise any suitable number of speaker drivers 810. In addition, any suitable number of speakers 812 may be coupled to the audio amplifier application 800 up to the number of speaker drivers 810 included in the application 800.

For some embodiments, the control bus 818 may be capable of providing an enable signal to the audio amplifier application 800. Also, for some embodiments, a plurality of similar or identical audio amplifier applications 800 may be daisy-chained together, with each audio amplifier application 800 capable of enabling a subsequent audio amplifier application 800 through use of the enable signal over the control bus 818.

While FIGS. 1 through 8 have illustrated various features of different types of audio systems, any number of changes may be made to these drawings. For example, while certain numbers of channels may be shown in individual figures, any suitable number of channels can be used to transport any suitable type of data. Also, the components shown in the figures could be combined, omitted, or further subdivided and additional components could be added according to particular needs. In addition, features shown in one or more figures above may be used in other figures above.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases that have been used within this patent document. The term "couple" and its derivatives refer to any direct or indirect communication between two or more components, whether or not those components are in physical contact with one another. The terms "include" and "comprise," as well as derivatives thereof, mean inclusion without limitation. The term "or" is inclusive, meaning and/or. The term "each" means every one of at least a subset of the identified items. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this invention. Other changes, substitutions, and alterations are also possible without departing from the spirit and scope of this invention as defined by the following claims.

What is claimed is:

1. A system for generating left and right virtual sound sources from two or more audio inputs using a speaker array, comprising:

a speaker array including a plurality of speakers;

a spatial sound processor coupled to receive the audio inputs, and configured to generate the left and right virtual sound sources, including a first stage configured to generate left and right sound source positioning signals associated with the left and right virtual sound sources, the first stage including for each audio input, left and right pre-filters configured to filter the audio input based on a predetermined spatial cueing function, and provide respective left and right spatial cueing signals; and left and right first stage mixers configured to mix respective left and right spatial cueing signals from the left and right pre-filters, and generate the left and right sound source positioning signals; and a second stage coupled to receive the left and right sound source positioning signals, and configured to generate for each speaker a corresponding speaker driver signal associated with the left and right virtual sound sources, the second stage including, for each speaker, left and right array filters configured to respectively filter the left and right sound source positioning signals, and provide left and right beamforming signals associated with the left and right virtual sound sources, and a second stage mixer configured to mix the left and right beamforming signals to generate the speaker driver signal for the associated speaker;

wherein the speaker array is responsive to the speaker driver signal for each speaker of the speaker array to generate the left and right virtual sound sources.

2. The system of claim 1, wherein the spatial sound processor receives more than two audio inputs.

3. The system of claim 1, wherein each spatial cueing function is a Head-Related Transfer Function (HRTF).

4. The system of claim 1, wherein the left and right pre-filters are further configured to apply a predetermined repositioning function corresponding to repositioning the left and right virtual sound sources, such that the left and right sound source positioning signals are a function of spatial cueing and repositioning.

5. The system of claim 1, further comprising:

a third stage coupled to the first stage, the third stage comprising a sound enhancer configured to generate for each audio input an enhanced audio input for the first stage, wherein the first stage is configured to generate the left and right sound source positioning signals based on the enhanced audio inputs.

6. A method for generating a sound stage with left and right virtual sound sources from two or more audio inputs using a speaker array with a plurality of speakers, comprising:

for each audio input, generating left and right spatial cueing signals based on a predetermined spatial cueing function;

mixing respective left and right spatial cueing signals to generate left and right sound source positioning signals associated with the left and right virtual sound sources;

for each speaker of the speaker array, generating a speaker driver signal associated with the left and right virtual sound sources by:

filtering the left and right sound source positioning signals to generate left and right beamforming signals associated with the left and right virtual sound sources; and mixing the left and right beamforming signals to generate the speaker driver signal for the associated speaker; and generating the left and right virtual sound sources through the speaker array based on the speaker driver signals input to respective speakers of the speaker array.

7. The method of claim 6, wherein the left and right virtual sound sources are generated from more than two audio inputs.

8. The method of claim 6, wherein generating left and right spatial cueing signals comprises:

for each audio input, generating left and right spatial cueing signals based on a predetermined spatial cueing function and a predetermined repositioner function for repositioning the left and right virtual sound sources.

9. The method of claim 6, wherein each spatial cueing function is a Head-Related Transfer Function (HRTF).

10. The method of claim 6, further comprising generating, for each audio input, an enhanced audio input;

wherein the left and right sound source positioning signals are generated based on the enhanced audio inputs.

11. A spatial sound processor for generating, through a speaker array with a plurality of speakers, a sound stage with left and right virtual sound sources from two or more audio inputs, comprising:

an audio data interface configured to receive the audio inputs;

a first stage configured to generate, from the audio inputs, left and right sound source positioning signals associated with the left and right virtual sound sources, the first stage including for each audio input, left and right pre-filters configured to filter the audio input based on a predetermined spatial cueing function, and provide respective left and right spatial cueing signals; and left and right first stage mixers configured to mix respective left and right spatial cueing signals from the left and right pre-filters, and generate the left and right sound source positioning signals; and a second stage coupled to receive the left and right sound source positioning signals, and configured to generate for each speaker a corresponding speaker driver signal associated with the left and right virtual sound sources, the second stage including, for each speaker, left and right array filters configured to respectively filter the left and right sound source positioning signals, and provide left and right beamforming signals associated with the left and right virtual sound sources, and a second stage mixer configured to mix the left and right beamforming signals to generate the speaker driver signal for the associated speaker;

wherein the speaker array is responsive to the speaker driver signal for each speaker of the speaker array to generate the left and right virtual sound sources.

12. The spatial sound processor of claim 11, wherein the spatial sound processor receives more than two audio inputs.

13. The spatial processor of claim 11, wherein the left and right pre-filters are further configured to apply a predetermined repositioning function corresponding to repositioning the left and right virtual sound sources, such that the left and right sound source positioning signals are a function of spatial cueing and repositioning.

14. The spatial processor of claim 11, wherein each spatial cueing function is a Head-Related Transfer Function (HRTF).

15. The spatial processor of claim 11, further comprising:

a third stage coupled to the first stage, the third stage comprising a sound enhancer configured to generate for each audio input an enhanced audio input for the first stage, wherein the first stage is configured to generate the left and right sound source positioning signals based on the enhanced audio inputs.

* * * * *